US010418218B2

(12) United States Patent
Lee

(10) Patent No.: US 10,418,218 B2
(45) Date of Patent: Sep. 17, 2019

(54) MULTISTAGE FUSE

(71) Applicant: LG Chem, Ltd., Seoul (KR)

(72) Inventor: Jaechan Lee, Daejeon (KR)

(73) Assignee: LG CHEM, Ltd. (KR)

( * ) Notice: Subject to any disclaimer, the term of this patent is extended or adjusted under 35 U.S.C. 154(b) by 0 days.

(21) Appl. No.: 15/775,274

(22) PCT Filed: Jul. 6, 2017

(86) PCT No.: PCT/KR2017/007207
§ 371 (c)(1),
(2) Date: May 10, 2018

(87) PCT Pub. No.: WO2018/008990
PCT Pub. Date: Jan. 11, 2018

(65) Prior Publication Data

US 2018/0323029 A1 Nov. 8, 2018

(30) Foreign Application Priority Data

Jul. 8, 2016 (KR) ..... 10-2016-0086841

(51) Int. Cl.
*H01H 85/055* (2006.01)
*H01H 85/143* (2006.01)
(Continued)

(52) U.S. Cl.
CPC ..... *H01H 85/055* (2013.01); *H01H 85/08* (2013.01); *H01H 85/143* (2013.01);
(Continued)

(58) Field of Classification Search
CPC ..... H01H 85/143; H01H 85/08; H01H 85/36; H01H 85/055; H01H 85/20; H01H 85/28; H01R 13/2421; H01R 13/24
(Continued)

(56) References Cited

U.S. PATENT DOCUMENTS 531,355 A * 12/1894 Ashley ..... H01H 85/28 337/284
772,200 A * 10/1904 Addie ..... H01H 85/28 337/284
(Continued)

FOREIGN PATENT DOCUMENTS

CN 102754179 A 10/2012
GB 645793 A * 11/1950 ..... H01H 85/20
(Continued)

OTHER PUBLICATIONS

International Search Report and Written Opinion for Application No. PCT/KR2017/007207 (with English Translation of Search Report), dated Sep. 21, 2017 (9 pages).
(Continued)

*Primary Examiner* — Anatoly Vortman
(74) *Attorney, Agent, or Firm* — Lerner, David, Littenberg, Krumholz & Mentlik, LLP

(57) ABSTRACT

The present invention relates to a multistage fuse, and more particularly, to a multistage fuse including: a fuse module including a first fuse bar formed in a bar shape as a conductive member; a melted portion which supports the first fuse bar and is melted when overcurrent flows; and a second fuse bar which supports the melted portion; and a contact terminal which contacts the first fuse bar by elastic force, in which when the overcurrent flows on the melted portion, the melted portion is melted to disconnect the first fuse bar and the contact terminal.

5 Claims, 4 Drawing Sheets

(51) Int. Cl.

| | |
|---|---|
| ***H01R 13/24*** | (2006.01) |
| ***H01H 85/20*** | (2006.01) |
| ***H01H 85/08*** | (2006.01) |
| ***H01H 85/28*** | (2006.01) |
| ***H01H 85/36*** | (2006.01) |

(52) U.S. Cl.
CPC ..... *H01H 85/20* (2013.01); *H01H 85/28* (2013.01); *H01H 85/36* (2013.01); *H01R 13/24* (2013.01); *H01R 13/2421* (2013.01)

(58) Field of Classification Search
USPC ..... 337/230, 257–259, 284, 285
See application file for complete search history.

(56) References Cited

U.S. PATENT DOCUMENTS

| | | | | | |
|---|---|---|---|---|---|
| 950,389 | A * | 2/1910 | Green | H01H 85/28 | 337/284 |
| 1,053,096 | A * | 2/1913 | Johnston | H01H 85/28 | 337/284 |
| 1,715,799 | A | 6/1929 | Taylor | | |
| 1,773,983 | A * | 8/1930 | Foo | H01H 85/28 | 337/213 |
| 2,874,248 | A * | 2/1959 | Tondat | H01H 85/263 | 200/572 |
| 5,475,357 | A * | 12/1995 | Chien | H01H 85/26 | 337/227 |
| 5,861,793 | A * | 1/1999 | Hatton | H01H 85/26 | 337/227 |
| 2010/0165774 | A1 | 7/2010 | Lee | | |

FOREIGN PATENT DOCUMENTS

| | | | |
|---|---|---|---|
| IN | 6801/CHENP/2012 | | 12/2013 |
| JP | 4014345 | B2 | 7/1965 |
| JP | 2013-175389 | A | 9/2013 |
| KR | 20-1999-0019539 | U | 6/1999 |
| KR | 10-2006-0118835 | A | 11/2006 |
| KR | 10-2010-0019782 | A | 2/2010 |
| KR | 10-2016-005110 | A | 5/2016 |

OTHER PUBLICATIONS

Extended European Search Report including Written Opinion for Application No. EP17824546.0 dated Dec. 3, 2018.
Chinese Search Report for CN Application No. 201780003962.4, dated Dec. 18, 2018.

* cited by examiner

MULTISTAGE FUSE

TECHNICAL FIELD

This application claims priority to and the benefit under 35 U.S.C. § 119 of Korean Patent Application No. 10-2016-0086841 filed in the Korean Intellectual Property Office on Jul. 8, 2016, and under 35 U.S.C. § 365 to PCT/KR2017/007207 filed on Jul. 6, 2017, the entire contents of which are incorporated herein by reference.

The present invention relates to a multistage fuse, and more particularly, to a multistage fuse including: a fuse module including a first fuse bar formed in a bar shape as a conductive member; a meltable portion which supports the first fuse bar and is melted when overcurrent flows; and a second fuse bar which supports the meltable portion; and a contact terminal which contacts the first fuse bar by elastic force, so that even if any one fuse module is fused due to temporary overcurrent and the current is thus momentarily interrupted, the system can be continuously used by using the other fuse module without replacing the fuse.

BACKGROUND

A fuse as a device that serves to protect a circuit or system by blocking overcurrent is widely used in most circuits for circuit protection for preventing secondary damage such as or fire. In general, the fuse has its unique rated current capacity, and the rated current capacity is determined by a metal component constituting the fuse.

However, the fuse in the related art is fused by only transient surge current to interrupt current, so that a whole system can not be used until the fuse is replaced by interrupting the current. For example, if the overcurrent occurs in a battery system of an electric vehicle, and the fuse is fused, there is inconvenience that an automobile can not be used until the fuse is replaced at an auto shop. In addition, since one rated current capacity is determined for each fuse, it is impossible to limit the current at various levels according to the need of a user and a purpose or use of the system.

Therefore, there is a growing need for researching fuses that have various rated current capacities and can perform overcurrent interruption operations several times.

SUMMARY

In order to solve the problem and an object of the present invention is to provide a multistage fuse which includes: a fuse module including a first fuse bar formed in a bar shape as a conductive member; a meltable portion which supports the first fuse bar and is melted when overcurrent flows; and a second fuse bar which supports the meltable portion; and a contact terminal which contacts the first fuse bar by elastic force and which allows each fuse module to have various rated current capacities to secure stepwise stability of a system and perform overcurrent interruption several times.

A multistage fuse according to an embodiment of the present invention may include: a fuse module including a first fuse bar formed in a bar shape as a conductive member; a meltable portion which supports the first fuse bar and is melted when overcurrent flows; and a second fuse bar which supports the meltable portion; and a contact terminal which contacts the first fuse bar by elastic force, in which when the overcurrent flows on the meltable portion, the meltable portion is melted to disconnect the first fuse bar and the contact terminal.

In the multistage fuse, the number of fuse modules may be 2 or more.

In the fuse module, respective fuse modules may have different rated capacities of the meltable portions.

The contact terminal may include a contact tip formed by the conductive member and contacting the first fuse bar, and an elastic member pushing the contact tip in the direction of the first fuse bar.

The contact tip may be formed in a cylindrical shape, and the contact terminal may further include a contact support unit accommodating a part of the contact tip therein.

A conductive circuit contacting the contact tip may be formed in an inner portion of the contact support unit and an outer portion of the contact support unit may be formed by a non-conductive member.

According to an embodiment of the present invention, even if any one fuse module is fused due to temporary overcurrent and the current is thus momentarily interrupted, a system can be continuously used by using the other fuse module without replacing the fuse and rated current levels of respective fuse modules can be variously set for the need of a user or efficient driving of the system.

DETAILED DESCRIPTION

Figure 1:
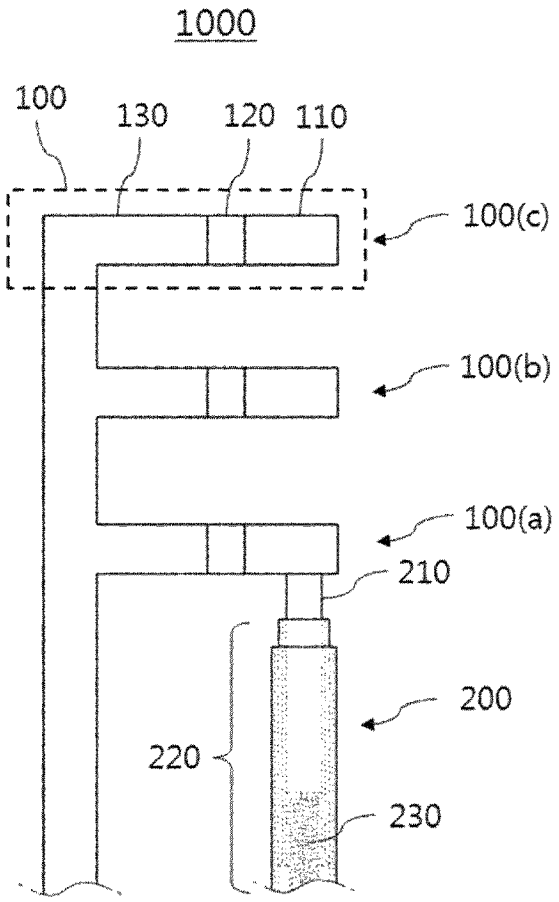
FIG. 1 is a diagram schematically illustrating a multistage fuse according to an embodiment of the present invention.

The present invention will be described below in detail with reference to the accompanying drawings. Herein, the repeated description and the detailed description of publicly-known function and configuration that may make the gist of the present invention unnecessarily ambiguous will be omitted. Embodiments of the present invention are provided for more completely describing the present invention to those skilled in the art. Accordingly, shapes, sizes, and the like of elements in the drawings may be exaggerated for clearer explanation.

Throughout the specification, unless explicitly described to the contrary, a case where any part "includes" any component will be understood to imply the inclusion of stated components but not the exclusion of any other component.

In addition, the term "unit" disclosed in the specification means a unit that processes at least one function or operation, and the unit may be implemented by hardware or software or a combination of hardware and software.

FIG. 1 is a diagram schematically illustrating a multistage fuse according to an embodiment of the present invention.

Referring to FIG. 1, the multistage fuse 1000 according to the embodiment of the present invention may include a fuse module 100 and a contact terminal 200.

The fuse module 100 may include a first fuse bar 110, a meltable portion 120, and a second fuse bar 130.

The first fuse bar 110 may be formed in a bar shape as a conductive member. The first fuse bar 110 is in direct contact with the contact terminal 200 to be described later and serves to allow current to flow between the second fuse bar and the contact terminal to be described later.

The meltable portion 120 may be a member that is melted when overcurrent flows. In general, a rated capacity of a fuse is determined according to physical characteristics of the meltable portion 120. The meltable portion 120 may serve to support the first fuse bar 110 before the overcurrent flows. However, since the meltable portion 120 is melted when the overcurrent flows, the meltable portion 120 may not serve to support the first fuse bar 110. Therefore, when the overcurrent flows to the meltable portion 120, the meltable portion 120 is melted, and as a result, the contact between the first fuse bar 110 and the contact terminal 200 is broken.

The number of fuse modules 100 may be 2 or more. The existing fuse is fused (melted) by temporary overcurrent, and as a result, a entire system connected with the fuse may not be used. However, in the multistage fuse according to the embodiment of the present invention, even if any one fuse module 100 is fused due to the temporary overcurrent and current is thus interrupted, the system may be continuously used by using the other fuse module 100 without replacing the fuse. In the multistage fuse according to the embodiment of the present invention, when fusing occurs due to the overcurrent, the current is momentarily interrupted and the entire system may be stopped by recognizing the current interruption by a battery control system (for example, BMS). Thereafter, when a user presses a reset button again, the system is restarted, and as a result, repetitive replacement of the fuse is minimized while maintaining an inherent function of the fuse by restarting the system, thereby preventing the system from being unnecessarily interrupted.

In the fuse module 100, respective fuse modules 100 may have different rated capacities of the fused portions 120. When the fuse module 100 (hereinafter referred to as a "first fuse module 100(*a*)") which is first connected with the contact terminal 200, the fuse module 100 (hereinafter, referred to as a "second fuse module 100(*b*)") which is connected with the contact terminal 200 when the first fuse module 100(*a*) is fused, and the fuse module 100 (hereinafter, referred to as a "third fuse module 100(*c*)") connected with the contact terminal 200 when the second fuse module 100(*b*) is fused may be different from each other in rated capacity of the meltable portion 120. In this case, rated current levels of the respective fuse modules 100 may be variously set for the need of the user or efficient driving of the system.

Figure 2:
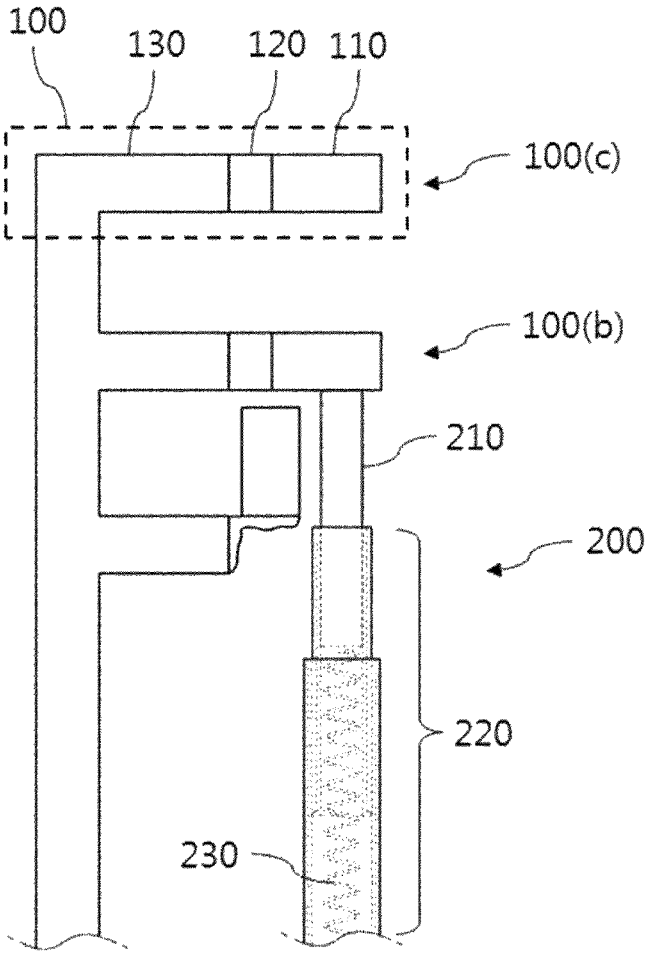
FIGS. 2 and 3 are diagrams schematically illustrating a state in which meltable portions of some fuse modules of the multistage fuse are melted according to the embodiment of the present invention.
Figure 3:
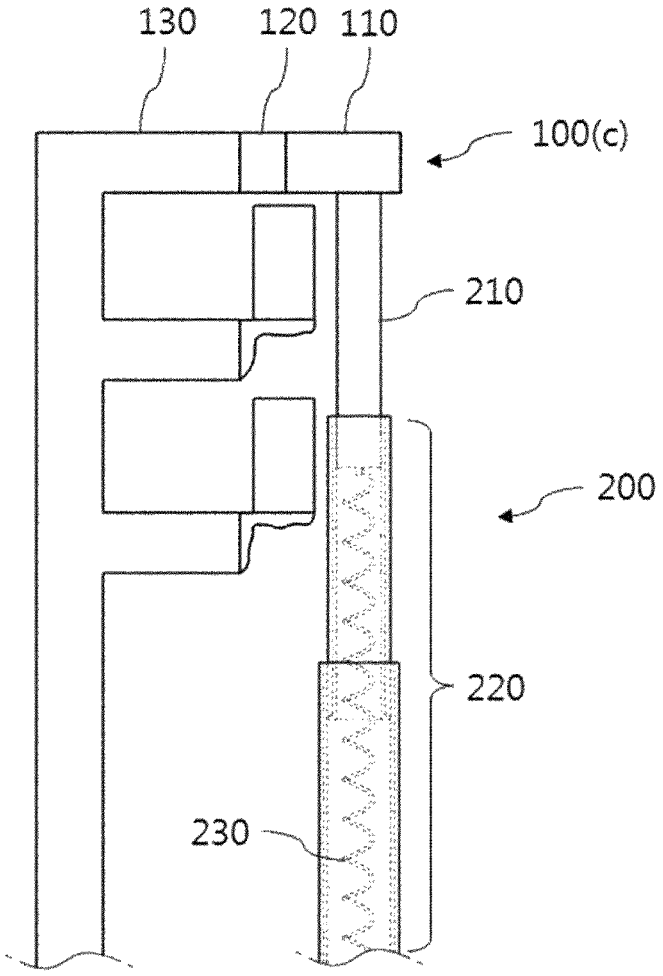
Figure 4:
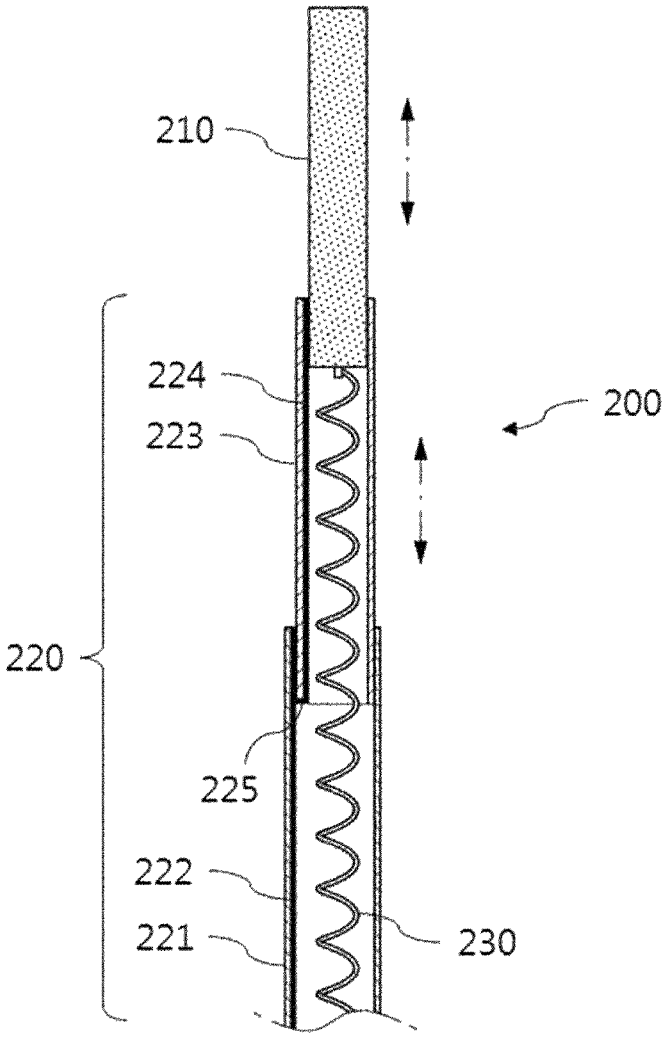
FIG. 4 is a diagram schematically illustrating a contact terminal of the multistage fuse according to the embodiment of the present invention.

FIGS. 2 and 3 are diagrams schematically illustrating a state in which meltable portions 120 of some fuse modules 100 of the multistage fuse according to the embodiment of the present invention are melted and FIG. 4 is a diagram schematically illustrating a contact terminal 200 of the multistage fuse according to the embodiment of the present invention.

For example, if the first fuse module 100(*a*) sets the rated current capacity to 100 A, the second fuse module 100(*b*) sets the rated current capacity to 150 A, and the second fuse module 100(*b*) sets the rated current capacity to 200 A, when overcurrent of 100 A or more flows on the multistage fuse, the first fuse module 100(*a*) is fused and the contact terminal 200 is disconnected from the first module 100(*a*), and as a result, the current is interrupted and thereafter, the contact terminal 200 contacts the first fuse bar 110 of the second fuse module 100(*b*), and as a result, the current may flow on the system again as illustrated in FIG. 2. In this case, once the current is interrupted by a control unit of the system, it is preferable that the system is operated again only when the user inputs a reset signal by pressing a reset button. Thereafter, when the overcurrent of 150 A or more flows on the multistage fuse again, the second fuse module 100(*b*) is fused and the contact terminal 200 is disconnected from the second fuse module 100(*b*), and as a result, the current is interrupted and thereafter, the contact terminal 200 contacts the first fuse bar 110 of the third fuse module 100(*c*), and as a result, the current may flow on the system again as illustrated in FIG. 3.

When current of 200 A or more flows, the system is finally interrupted. Therefore, it is possible to continuously drive the system by minimizing the fuse replacement while ensuring the stability of the system step by step according to the need of the user or the purpose and usage of the system.

The second fuse bar 130 may serve to support the meltable portion 120. The second fuse bar 130 may be made of the same material as the first fuse bar 110, but may be made of another material. The second fuse bar 130 may be connected to another wire (not illustrated) or circuit (not illustrated) to allow the current to flow on the multistage fuse.

The contact terminal 200 may contact the first fuse bar 110 by elastic force. More specifically, the contact terminal 200 may include a contact tip 210 and an elastic member.

The contact tip 210 may be formed of a conductive member on which the current may flow and may contact the first fuse bar 110. The shape of the contact tip 210 is not particularly limited, but it is preferable that one portion of the contact tip 210 is formed in a long shape so that a part of the contact tip 210 may be accommodated in a contact support to be described later. As one example, the contact tip 210 may be formed in a cylindrical shape.

The elastic member is a member having the elastic force due to a change in length, and may serve to push the contact tip 210 in the direction of the first fuse bar 110. For example, the elastic member may be a spring 230.

The contact terminal 200 may further include a contact support unit 220 accommodating a part of the contact tip 210 therein. The contact support unit 220 may serve to guide movement of the contact tip 210 by the elastic member. For example, when the contact tip 210 is formed in the cylindrical shape, the contact support unit 220 is formed in the cylindrical shape to guide the contact tip 210 to move in the direction of the first fuse bar 110 by the elastic member. Further, the contact support unit 220 may be formed of two or more members. The contact support unit 220 may be formed in a multistage structure including two or more members. For example, as illustrated in FIGS. 1 to 4, the contact support unit 220 may be formed in a shape in which cylinders having different diameters are overlapped.

Referring to FIG. 4, the contact support unit 220 may include conductive circuits 222 and 224 which contact the contact tip 210 therein. The conductive circuits 222 and 224 may serve to allow the current to flow in connection with another wire (not illustrated) through contact with the contact tip 210. When the contact support unit 220 is formed in the multistage structure including two or more members, the contact support unit 220 may include a connection tip 225 connecting conductive circuits of the respective members.

Further, an outer portion of the contact support unit 220 may be formed by non-conductive members 221 and 223. When the meltable portion(s) 120 of the first fuse module 100(*a*) and/or the second fuse module 100(*b*) is(are) melted, it may be difficult that the first fuse bar 110 may be bent accurately in an orthogonal direction to the second fuse bar 130. Therefore, the outer portion of the contact support unit 220 is formed by the non-conductive member to prevent the first fuse bar(s) 110 of the melted first fuse module 100(*a*)

and/or the second fuse module 100(*b*) and the contact tip 210 from abnormally contacting each other.

Hereinabove, a specific embodiment of the present invention has been illustrated and described, but the technical spirit of the present invention is not limited to the accompanying drawings and the described contents and it is apparent to those skilled in the art that various modifications of the present invention can be made within the scope without departing from the spirit of the present invention and it will be regarded that the modifications are included in the claims of the present invention without departing from the spirit of the present invention.

The invention claimed is:

1. A multistage fuse comprising:

a plurality of fuse modules aligned in a first direction, each fuse module including a first fuse bar formed in a bar shape as a first electrically conductive member; a meltable portion which supports the first fuse bar and is melted when overcurrent flows; and a second fuse bar which supports the meltable portion; and a contact terminal which contacts the first fuse bar of a given fuse module by elastic force, wherein when the overcurrent flows on the meltable portion, the meltable portion is melted to disconnect the contact terminal from the first fuse bar of given fuse module, and the elastic force pushes the contact terminal in the first direction towards a next fuse module.

2. The multistage fuse of claim 1, wherein respective ones of the plurality of fuse modules have different rated capacities of the respective meltable portions of the fuse modules.

3. The multistage fuse of claim 1, wherein the contact terminal includes a contact tip formed by a second electrically conductive member and contacting the first fuse bar of the given fuse module, and an elastic member pushing the contact tip in the direction of the first fuse bar of the given fuse module.

4. The multistage fuse of claim 3, wherein the contact tip is formed in a cylindrical shape, and the contact terminal further includes a contact support unit accommodating a part of the contact tip therein.

5. The multistage fuse of claim 4, wherein an electrically conductive circuit contacting the contact tip is formed in an inner portion of the contact support unit and an outer portion of the contact support unit is formed by an electrically non-conductive member.

* * * * *